US011628644B2

(12) United States Patent
Maeyaert et al.

(10) Patent No.: US 11,628,644 B2
(45) Date of Patent: Apr. 18, 2023

(54) MULTIPLE-MODE CASE ERECTOR

(71) Applicant: Fallas Automation, Inc., Waco, TX (US)

(72) Inventors: Daniel Maeyaert, Waco, TX (US); David Fallas, Waco, TX (US); Jacob Cox, China Springs, TX (US)

(73) Assignee: Fallas Automation, Inc., Waco, TX (US)

( * ) Notice: Subject to any disclaimer, the term of this patent is extended or adjusted under 35 U.S.C. 154(b) by 341 days.

(21) Appl. No.: 17/091,339

(22) Filed: Nov. 6, 2020

(65) Prior Publication Data

US 2022/0143945 A1 May 12, 2022

(51) Int. Cl.

| | |
|---|---|
| ***B31B 50/50*** | (2017.01) |
| ***B31B 50/62*** | (2017.01) |
| ***B31B 50/73*** | (2017.01) |
| *B31B 120/30* | (2017.01) |
| *B31B 100/00* | (2017.01) |

(52) U.S. Cl.

CPC ..... *B31B 50/50* (2017.08); *B31B 50/62* (2017.08); *B31B 50/734* (2017.08); *B31B 2100/002* (2017.08); *B31B 2120/30* (2017.08)

(58) Field of Classification Search

CPC ... B31B 50/046; B31B 50/106; B31B 50/734; B65B 59/00

USPC ..... 493/76

See application file for complete search history.

(56) References Cited

U.S. PATENT DOCUMENTS

| | | | | |
|---|---|---|---|---|
| 3,427,931 A * | 2/1969 | Wainberg | B31B 50/00 | 493/137 |
| 3,952,635 A * | 4/1976 | Mims | B31B 50/00 | 271/31.1 |
| 3,982,474 A * | 9/1976 | Klund | B65B 43/305 | 493/18 |
| 5,186,706 A * | 2/1993 | Hartness | B31B 50/066 | 414/795.8 |
| 5,393,291 A * | 2/1995 | Wingerter | B31B 50/80 | 493/317 |
| 6,106,450 A * | 8/2000 | Brittain | B31B 50/78 | 493/171 |
| 2003/0040413 A1* | 2/2003 | Malecki | B65B 59/003 | 493/309 |

* cited by examiner

*Primary Examiner* — Andrew M Tecco
*Assistant Examiner* — Jacob A Smith
(74) *Attorney, Agent, or Firm* — Crowell & Moring LLP

(57) ABSTRACT

A case erector may operate in multiple modes. In a slotted-case mode, the case erector may accept and erect slotted cases, while various plunger-case erection components are deactivated. In a plunger-case mode, the case erector may accept and erect plunger cases, while various slotted-case erection components are deactivated.

20 Claims, 10 Drawing Sheets

MULTIPLE-MODE CASE ERECTOR

TECHNICAL FIELD

This disclosure relates to a multiple-mode case erector.

BACKGROUND

In various industries, products may be packed into cases for example, for shipment or storage. Increasingly, interest has grown in the area of display cases that can be used for both product shipment and sales display. Nevertheless, the demand for shipping-only cases have continued to grow with increasing adoption of online purchasing by end consumers.

DETAILED DESCRIPTION

Figure 1:
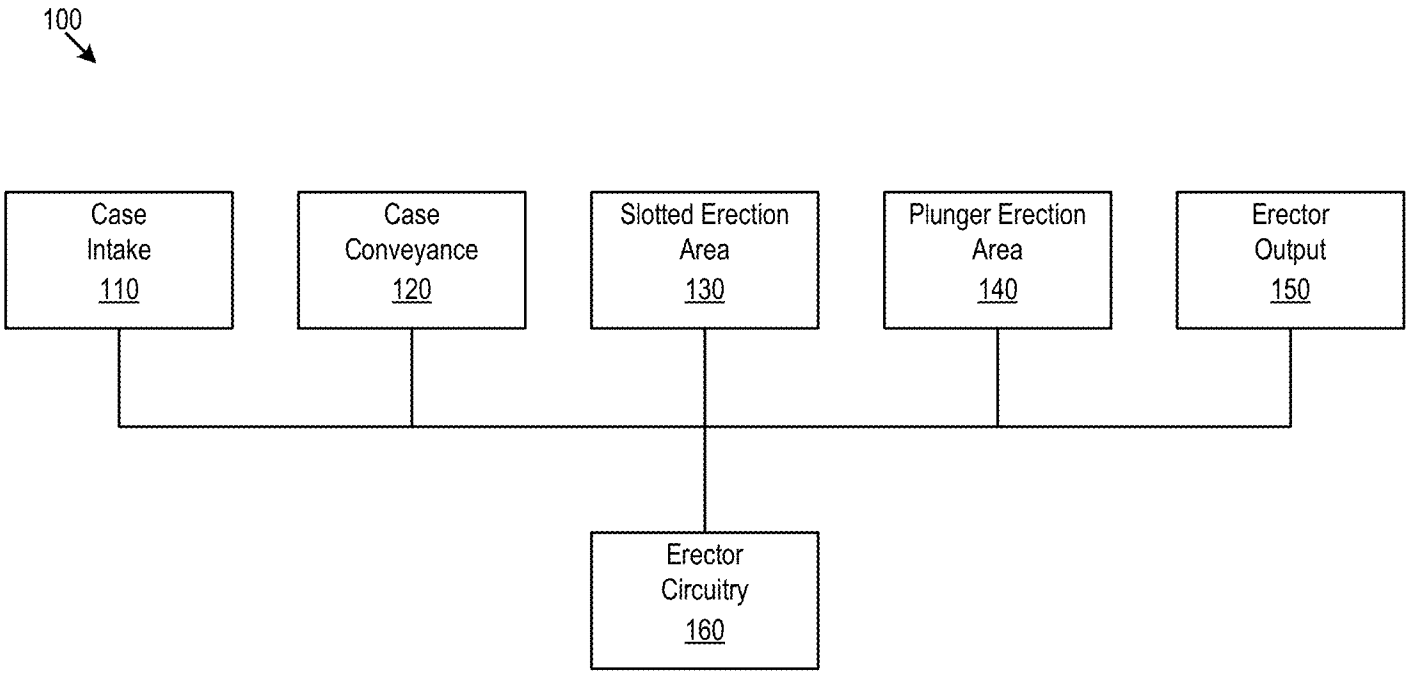
FIG. 1 shows a schematic view of an example case erector.

Cases may refer to various containers. In some instances, cases may be erectable, e.g., may be transformed (e.g., folded) from a flat state (e.g., for convenient bulk delivery to the packing site) to an erected state with an internal cavity ready for packing.

In various instances, erectable cases may include slotted cases (regular slotted containers, half slotted containers, or other slotted containers) which may be opened from their flat state and have flaps folded inward for erection.

Erectable cases may also include plunger and/or die cut cases that may be unfurled in a single layer when flat. Rather than being opened, such plunger cases may be forced by a plunger into case forming die (e.g., an assembly with an opening, cavity, and/or contours to fold together the sides of the case when plunged) to erect the plunger case.

In various scenarios, a packing plant may have one or more products for which it may be desirable to pack the products in slotted cases and one or more products for which may be desirable to pack the products in plunger cases. In some scenarios, the determination of which type of case to use may depend on the buyer of product. For example, 'big-box' retailers may prefer display cases (which often use a plunger design) while online retailers may prefer slotted cases, primarily for shipping purposes. Accordingly, a single type of product may be packed in different cases depending on the recipient.

The erection processes for plunger cases and slotted containers are clearly dissimilar. As discussed above, plunger case cases are pressed into a cavity and slotted containers are opened and have their flaps folded inward. Accordingly, it has been accepted in the conventional wisdom that the best solution for diverse packing needs has been to maintain separate packing lines dedicated to each type of case erection. Maintaining separate lines can be costly with regard to plant space and can negatively affect the output capacity of a plant. Likewise, adding a plunger case packing line to an existing facility utilizing only slotted cases may present a substantial investment.

Further, in some instances, plants may have imbalanced needs. For example, one erection type may account for a small or infrequent portion of the plant output. Accordingly, in lieu of producing dedicated lines or facilities to accommodate such sales, companies may simply forgo the sales and the associated revenues.

In view of the above, there has been a long-felt, generalized need for improvement in this regard. The techniques and architectures discussed herein (contrary to conventional wisdom) provide a case erector capable of both plunger-case erection and slotted-case erection, thereby eliminating the need for dedicated lines. Using the solutions herein, plants may have the flexibility to address diversity in customer packing requirements with smaller capital investment and/or material investments than needed for conventional solutions. Additionally, using the solutions herein, plants may address diversity in customer packing requirements, utilizing plant floor space comparable to that required by an individual case erector for slotted cases, or an individual case erector for plunger cases.

In some implementations, the multiple-mode case erectors discussed herein erect slotted cases on their side. Accordingly, the erected slotted cases may be tipped 90 degrees upon exit from the case erector. Such side erection was common in older (in some instances, obsolete) slotted-case erectors. Thus, conventional wisdom with regard to slotted case erection has been to erect slotted cases in an upright orientation to eliminate the need for the slotted cases to be tipped after erection. Some implementations discussed herein proceed contrary to conventional wisdom and use side erection for slotted cases. These side erection solutions realize increased commonality with plunger case erection relative to upright slotted case erection. In some instances, a footprint of a multiple-mode erector using side erection for slotted cases may be comparable to that of a single mode erector. However, multiple-mode solutions with upright slotted case erection may be used in various implementations.

FIG. 1 shows a schematic view of an example case erector 100. The case erector may include portions: case intake 110, case conveyance 120, slotted erection area 130, plunger erection area 140, erector output 150, and erector circuity 160. Various ones of the portions: case intake 110, case conveyance 120, slotted erection area 130, plunger erection area 140, and erector output 150, may occupy overlapping, partially overlapping, or distinct spaces of the case erector 100. For example, the erector circuitry 160 may include control circuitry and/or actuation circuitry that may occupy space in various others of the case intake 110, case conveyance 120, slotted erection area 130, and/or plunger erection area 140. For example, case conveyance 120 may convey cases to, through or out of other component spaces. For example, in some implementations, the slotted erection area and plunger erection area may overlap at least in part. For example, a case opener and/or flap doors/kicker (e.g., arms that fold slotted case flaps inward) may operate in the space where the plunger impacts plunger cases (albeit in different operation modes). In some implementations, the slotted erection area 130 and plunger erection area 140 may occupy distinct spaces.

In various implementations, case intake 110 may include various components including hoppers, case pullers or other components for feeding unerected cases to the case erector 100. A case hopper may include a cavity or other compartment for holding unerected cases for feeding through the case erector 100. The case hopper may have adjustable dividers or baffles that allow the space within the cavity or other compartment to be adjusted to the size of the cases held therein.

A case puller may include an engagement head that may engage with cases to pull cases from the hopper into the case erector 100. An engagement head may include a head (e.g., frictive, vacuum, statically charged, magnetic, gripping, pushing, or otherwise engaging) for engaging the case. The engagement head may be actuated (e.g., spun or translated) after engagement to move the case from the hopper into the case erector.

In various implementations, case conveyance 120 may include components to convey cases to various portions of the case erector 100. For example, case conveyance may include case pushers (such as belts, treads, belts with flaps for pushing) or other conveyance components for moving cases through the case erector. In various implementations, case conveyance 120 may include components that may be active or inactive depending on the operational mode of the case erector. For example, case conveyance 120 may include a bottom pusher for pushing erected/unerected cases from below and a top pusher for pushing cases (e.g., erected cases or partially erected cases) from above. In an example scenario, the top pusher may be inactive in one or modes while the bottom pusher is active in those modes (or, in some instances, all modes). In some implementations, other pushers such as side pushers may be used for case conveyance 120. The configuration of pushers may be selected based on the relative positioning of the slotted erection area 130, plunger erection area 140, and/or the erector output 150. Additionally or alternatively, the configuration of pushers may be selected based on whether slotted case erection is performed for upright erection or side erection.

In various implementations, the slotted erection area 130 may include components for slotted case erection. For example, the slotted erection area 130 case opener to open cases (e.g., from flat state into rectangular prism shape). In an example, the case opener may include an arm with a case head (which may be a vacuum head, an extendible rod or catch, statically charged, or otherwise engaging head). The case head may couple to the side of a slotted case while flat. In some implementations, a case back head may be used to couple to the bottom of the case while the case opened (in some instances, using a simple rod or catch head) may open the case. The arm may actuate 90 degrees opening the slotted case such that the flaps of the case may be folded freely. The slotted erection area 130 may include flap doors and/or flap kickers to fold in the flaps. The slotted erection area 130 may include adhesive heads that may apply adhesive before, during, and/or after the flaps have been folded in. For example, a glue head may apply glue before folding or after the minor flaps of a slotted case are folded inward. A tape head, may apply tape after the major flaps of the slotted case a folded inward.

In various implementations, the plunger erection area 140 may include a plunger. In various implementations, the plunger may include an arm with a head. In some instances, the head may be removable. The arm may be actuated (e.g., translated) to impact (e.g., contact and press) an unerected plunger case (e.g., a plunger case blank) into a case formation die. The case formation die may include an opening, a cavity, and/or sides that may fold the sides of unerected plunger around the case to erect the case while it is pushed through (and/or) into the case formation die.

In various implementations, the erector output 150 may include one or more outputs (e.g., one or more shared outputs or outputs for each mode). In various implementations, the erector output 150 may include removable, reorientable, and/or repositionable guides. The guides may control how cases exit the case erector. For example, the guides may tip cases (e.g., tip cases 90 degrees when they are erected on their side for tip-output operation). For example, if slotted cases are erected on their side, slotted cases may be tipped 90 degrees by the guides at output. In some instances, the guides may prevent slotted cases from falling into the case formation die, for example, if the slotted case passes through the plunger erection area 140 in transit to the output. In some implementations, plunger cases may be erected on their side (e.g., in some implementations where slotted cases may be erected upright, a plunger may press cases sideways through the case formation die). Similarly, side erected plunger cases may be tipped 90 degrees upon exit at the output. Erection of cases such that an upright case results (e.g., where the open side of the case points upward for filling) may be referred to as upright-output operation.

In various implementations, the erector circuity 160 may include control circuitry and/or actuators to drive components of the case erector. The control circuitry may include processors or other microelectronics to execute control operations causing the actuators to move. The actuators may include actuators of various types: valve actuators, linear actuators, angle actuators, stepper motors, servos, and/or other actuators. In some implementations, the erector circuitry may determine position information for the actuators (e.g., for servos, stepper motors, or other actuators with position information). In some instances, position information from a first component may be used to trigger motion in a second component (e.g., camming). In some instances, "trigger components" along with other components may aid in controlling the rate of throughput of the case erector. Trigger components, in some instances, refer to components within a case erector that may trigger (e.g., through position detection) operation of other components with the case erector. The erector circuitry 160 may further include operator displays and/or interfaces (e.g., graphical interfaces, human-input interfaces or other control inputs, and/or other interfaces) for control/monitoring of the case erector 100.

In various implementations, the order of one or more operations in any of the example methods may be flipped or changed relative to that as presented herein.

Figure 2:
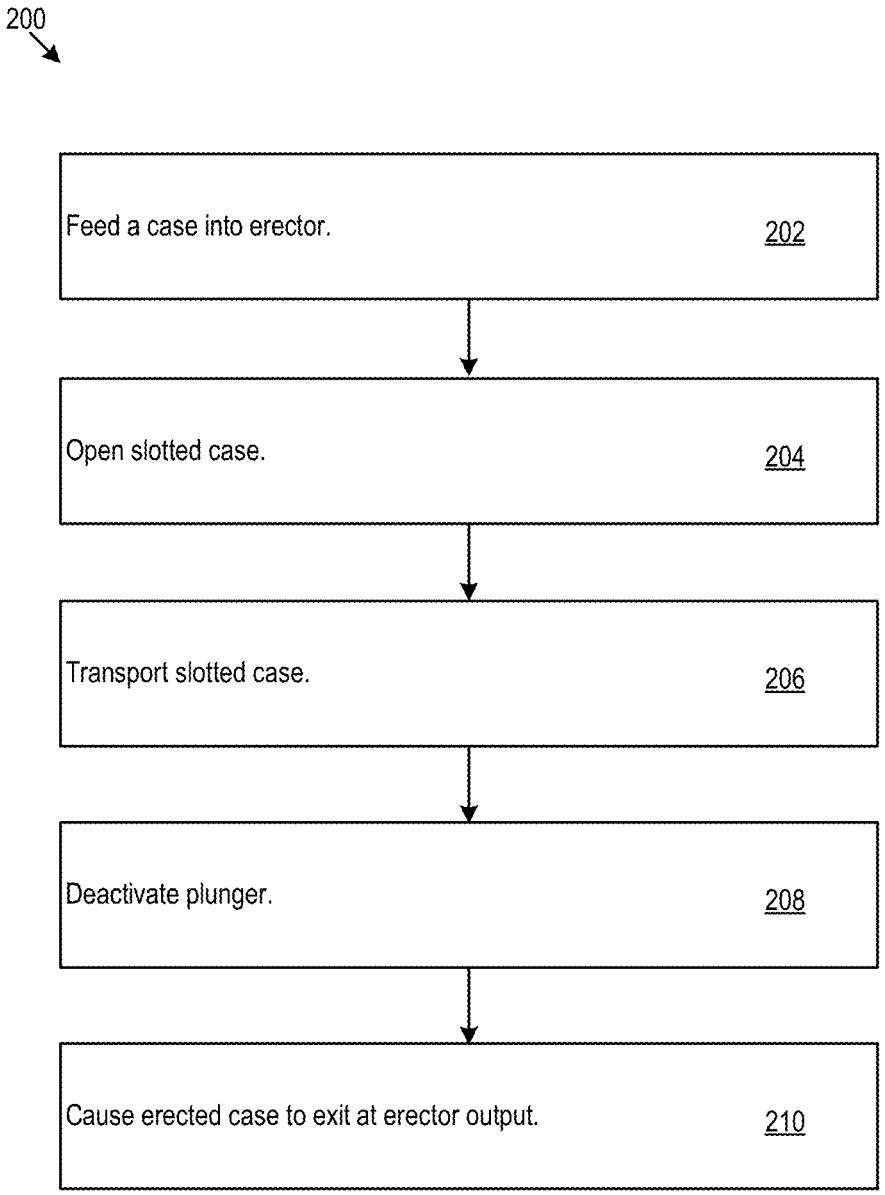
FIG. 2 shows an illustrative example method for an example slotted-case mode.

FIG. 2 shows an illustrative example method 200 for the slotted-case mode of the case erector 100. Case intake 110 may feed a case into the case erector 100 (202). In the slotted erection area 130, a slotted case may be opened by the case opener (204) and otherwise processed (e.g., flaps folded inward and adhered and/or other processing). Case conveyance 120, may transport the slotted case in, out, and/or through the slotted erection area 130 (206). In the plunger erection area 140, the plunger may be deactivated (208, e.g., maintained in a deactivated state). In various implementations, case conveyance 120 may transport erected/unerected slotted cases in, out, and/or through the plunger erection area 140 while the plunger in deactivated. The erected slotted case may exit the case erector at the erector output (210)

Figure 3:
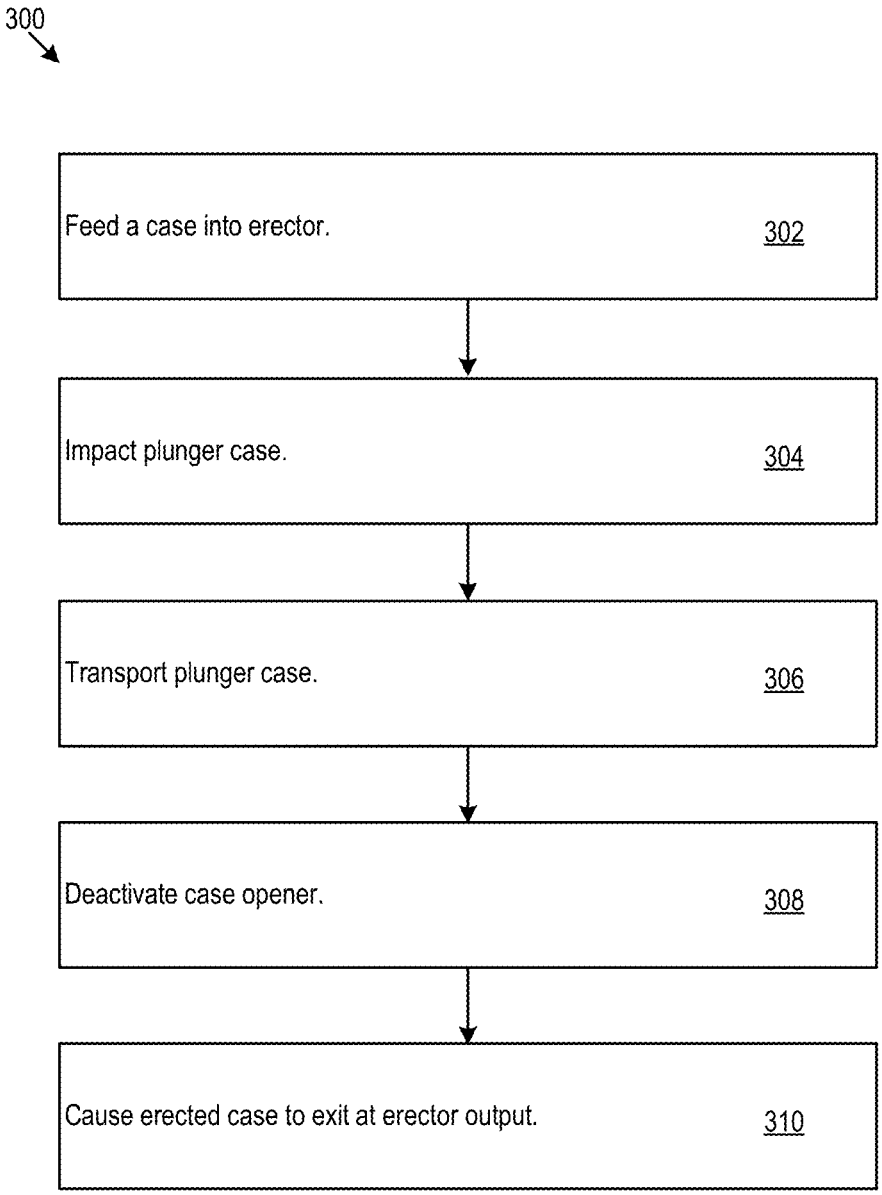
FIG. 3 shows an illustrative example method for an example plunger-case mode.

FIG. 3 shows an illustrative example method 300 for the plunger-case mode of the case erector 100. Case intake 110 may feed a case into the case erector 100 (302). In the plunger erection area 140, a plunger case may be impacted by the plunger (304) and otherwise processed (e.g., glue applied pre-plunging and/or other processing). Case conveyance 120, may transport the plunger case in, out, and/or through the plunger erection area 140 (306). In the slotted erection area 130, the case opener may be deactivated (308, e.g., maintained in a deactivated state). In various implementations, case conveyance 120 may transport erected/unerected plunger cases in, out, and/or through the slotted erection area 130 while the case opener is deactivated. The erected plunger case may exit the case erector at the erector output (310).

Figure 4:
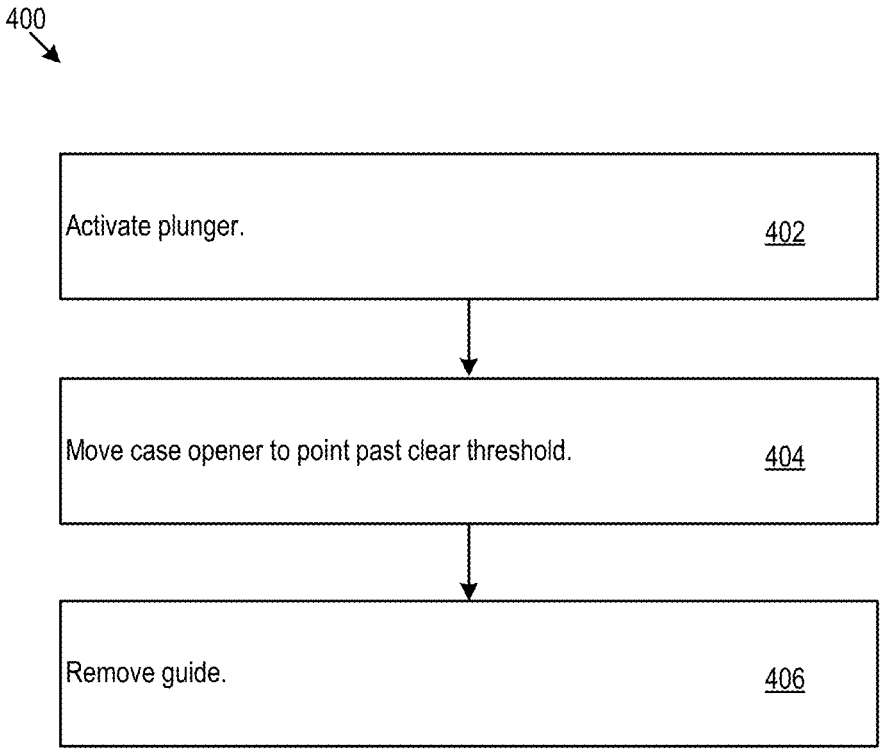
FIG. 4 shows an illustrative example method for transitioning from a slotted-case mode to a plunger-case mode.

FIG. 4 shows an illustrative example method 400 for transitioning the case erector 100 from a slotted-case mode to a plunger-case mode. The plunger may be activated and/or moved to a ready position (402). For example, the plunger may be moved from a point exceeding a clear threshold to the ready position. A clear threshold may include a position beyond which any component may be moved to avoid interference with a mode of operation in which that component is deactivated. The clear threshold may include a defined point within and/or at an end of an operational travel range of the component (e.g., the range of motion of the component used during at least some operation of the component). The clear threshold may be a point outside the operational travel range of the component. In some implementations, the clear threshold may be a point outside an actuatable range of the component and/or the component may not be actuated at least in the direction of the clear threshold. Accordingly, manual repositioning may be utilized to reach the clear threshold and/or return to the ready position in some implementations. In some implementations, a user interface and/or user-controlled circuitry may be used to reposition components. A ready position may include a defined position and/or engagement state consistent with operation of the component. In some instances, clear thresholds and/or ready positions may be defined based on the characteristics of the specific case to be erected in the new mode. For example, larger cases may have larger clear thresholds while smaller cases may have smaller clear thresholds.

Referring again to FIG. 4, the case opener may be deactivated and/or moved to a position exceeding a clear threshold for case opener (404). Guides to facilitate case output (e.g., tip-exit output) may also be removed, repositioned, and/or reoriented to clear for operation in the plunger case mode (406).

In some implementations, various other components may be adjusted/deactivated/activated to facilitate the transition, such as hoppers, case pullers, adhesive head (e.g., a tape head may be moved past a clear threshold, glue heads may be activated), case pushers (e.g., a top case pusher may be moved past a clear threshold), and/or other components.

Figure 5:
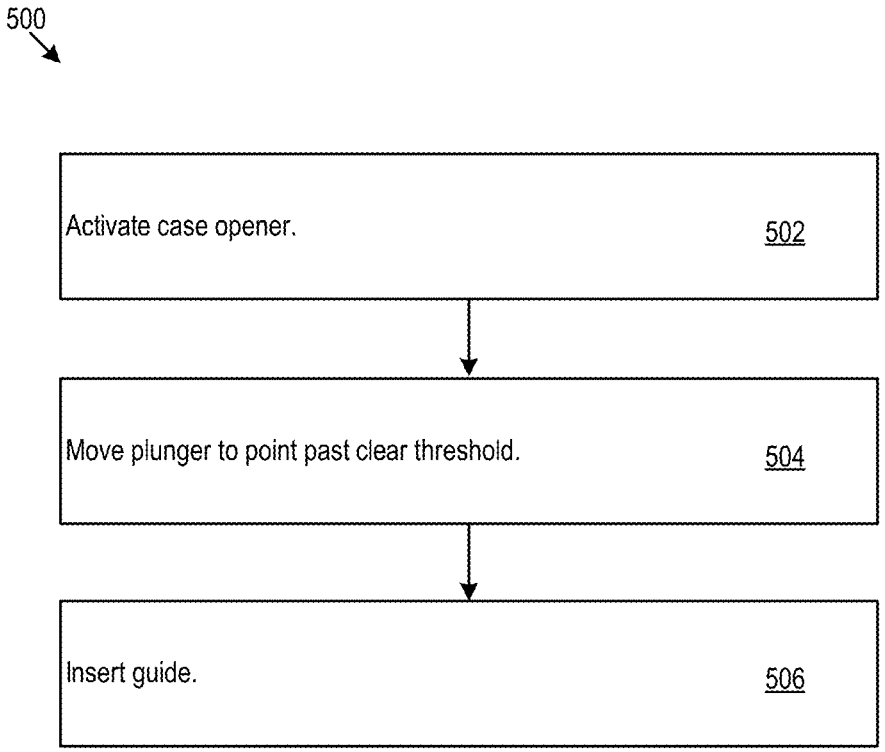
FIG. 5 shows an illustrative example method for transitioning from a plunger-case mode to a slotted-case mode.

FIG. 5 shows an illustrative example method 500 for transitioning the case erector 100 from a plunger-case mode to a slotted-case mode. The case opener may be activated and/or moved to a ready position (502). For example, the case opener may be moved from a point exceeding a clear threshold to the ready position. The plunger may be deactivated and/or moved to a position exceeding a clear threshold for case opener (504). For example, a plunger head may be removed while the plunger arm is repositioned past a clear threshold. Guides for to facilitate case output (e.g., tip-exit output) may be inserted, repositioned, and/or reoriented to facilitate for operation in the slotted-case mode (506).

In some implementations, various other components may be adjusted/deactivated/activated to facilitate the transition, such as hoppers, case pullers, adhesive heads (e.g., a tape head may be moved to a ready position and glue heads may be deactivated), case pushers (e.g., a top case pusher may be moved to a ready position), and/or other components.

In various implementations, a triggering component may trigger operation of triggered components via position information of the triggering component. In various implementations, the triggering behavior for a triggering component may change when operation changes modes. For example, a triggering component may have two triggering positions: one that is active during slotted-case operation and one that is active during plunger case operation. For example, the triggering component may trigger different components with each of the triggering positions depending on the operation mode. For example, a triggering component active in both modes may trigger a component in one mode, where that same component is deactivated in the other mode (and therefore such triggering would be ignored). In an example, a triggering component that is active in both modes may trigger the same triggered component in both modes but at different triggering positions for the triggering component. In some instances, a single trigger position for a triggering component may trigger different components depending on the mode of the case erector. For example, a single trigger position may trigger operation of a plunger in plunger-case mode while triggering operation of an adhesive head in slotted-case mode.

Figure 6:
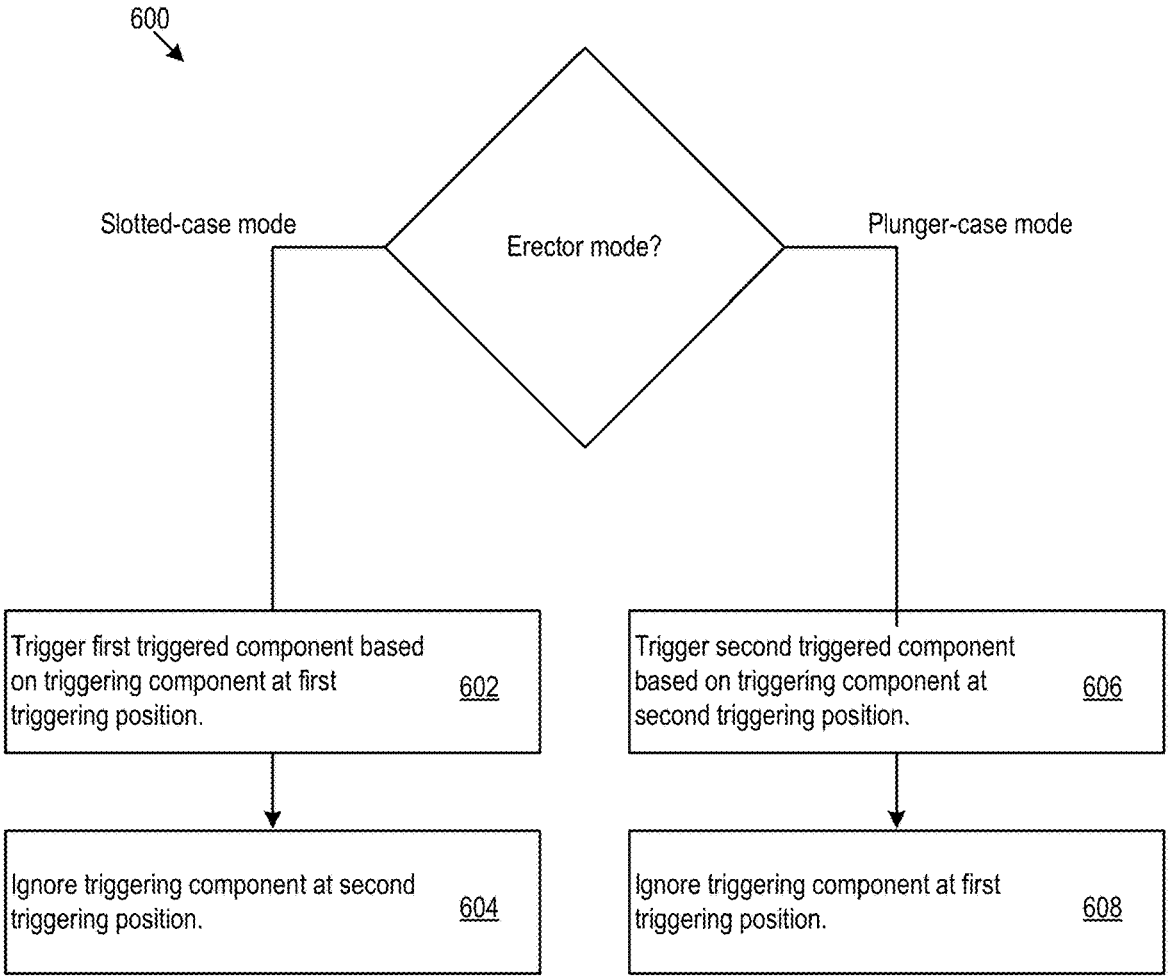
FIG. 6 shows an illustrative example method for multiple-mode component triggering.

FIG. 6 shows an illustrative example method 600 for multiple-mode component triggering. A triggering component may have a first triggering position and a second triggering position. In the slotted-case mode, the erector circuitry 160 may trigger a first triggered component based on a determination that the triggering component is at the first triggering position (602). In the slotted-case mode, the erector circuitry 160 may ignore a determination that the triggering component is at the second triggering position (604). In the plunger-case mode, the erector circuitry 160 may trigger a second triggered component based on a determination that the triggering component is at the second triggering position (606). In the slotted-case mode, the erector circuitry 160 may ignore a determination that the triggering component is at the first triggering position (608).

As an illustrative example, a case pusher may serve as the triggering component. In the slotted-case mode, the case pusher may reach a first triggering position during operation. Upon determination that the case pusher reached the first position the erector circuitry may activate a tape head (e.g., a first triggered component). In the illustrative example, in the plunger-case mode, the tape head may be deactivated and a glue head may be activated. The case pusher may reach a first triggering position during operation in the plunger-case mode. However, the first triggering position may be ignored because the tape head is deactivated. Further, in the illustrative example, the case pusher may reach a second triggering position. Upon determination that the case pusher reached the second position, the erector circuitry may activate the glue head (e.g., a second triggered component). Similarly, in the illustrative example, the glue head may be deactivated in the slotted-case mode. Thus, the second triggering position may be ignored in the slotted case mode.

The methods, devices, processing, and logic described above may be implemented in many different ways and in many different combinations of hardware and software. For example, all or parts of the implementations may be circuitry that includes an instruction processor, such as a Central Processing Unit (CPU), microcontroller, or a microprocessor; an Application Specific Integrated Circuit (ASIC), Programmable Logic Device (PLD), or Field Programmable Gate Array (FPGA); or circuitry that includes discrete logic or other circuit components, including analog circuit components, digital circuit components or both; or any combination thereof. The circuitry may include discrete interconnected hardware components and/or may be combined on a single integrated circuit die, distributed among multiple integrated circuit dies, or implemented in a Multiple Chip Module (MCM) of multiple integrated circuit dies in a common package, as examples.

The circuitry may further include or access instructions for execution by the circuitry. The instructions may be embodied as a signal and/or data stream and/or may be stored in a tangible storage medium that is other than a transitory signal, such as a flash memory, a Random Access Memory (RAM), a Read Only Memory (ROM), an Erasable Programmable Read Only Memory (EPROM); or on a magnetic or optical disc, such as a Compact Disc Read Only Memory (CDROM), Hard Disk Drive (HDD), or other magnetic or optical disk; or in or on another machine-readable medium. A product, such as a computer program product, may particularly include a storage medium and instructions stored in or on the medium, and the instructions when executed by the circuitry in a device may cause the device to implement any of the processing described above or in the example implementations below.

Example Implementations

Various illustrative example implementations are described below. The example implementations are intended to be illustrative of the techniques and architectures discussed above. Various individual features and/or combinations of features discussed below with regard to particular illustrative example implementations may be combined with various other implementations including other illustrative examples in accord with the techniques and architectures discussed above. Additionally or alternatively, various individual features and/or combinations of features may be added or omitted from the illustrative example implementations described below in accord with the techniques and architectures discussed above.

Figure 7:
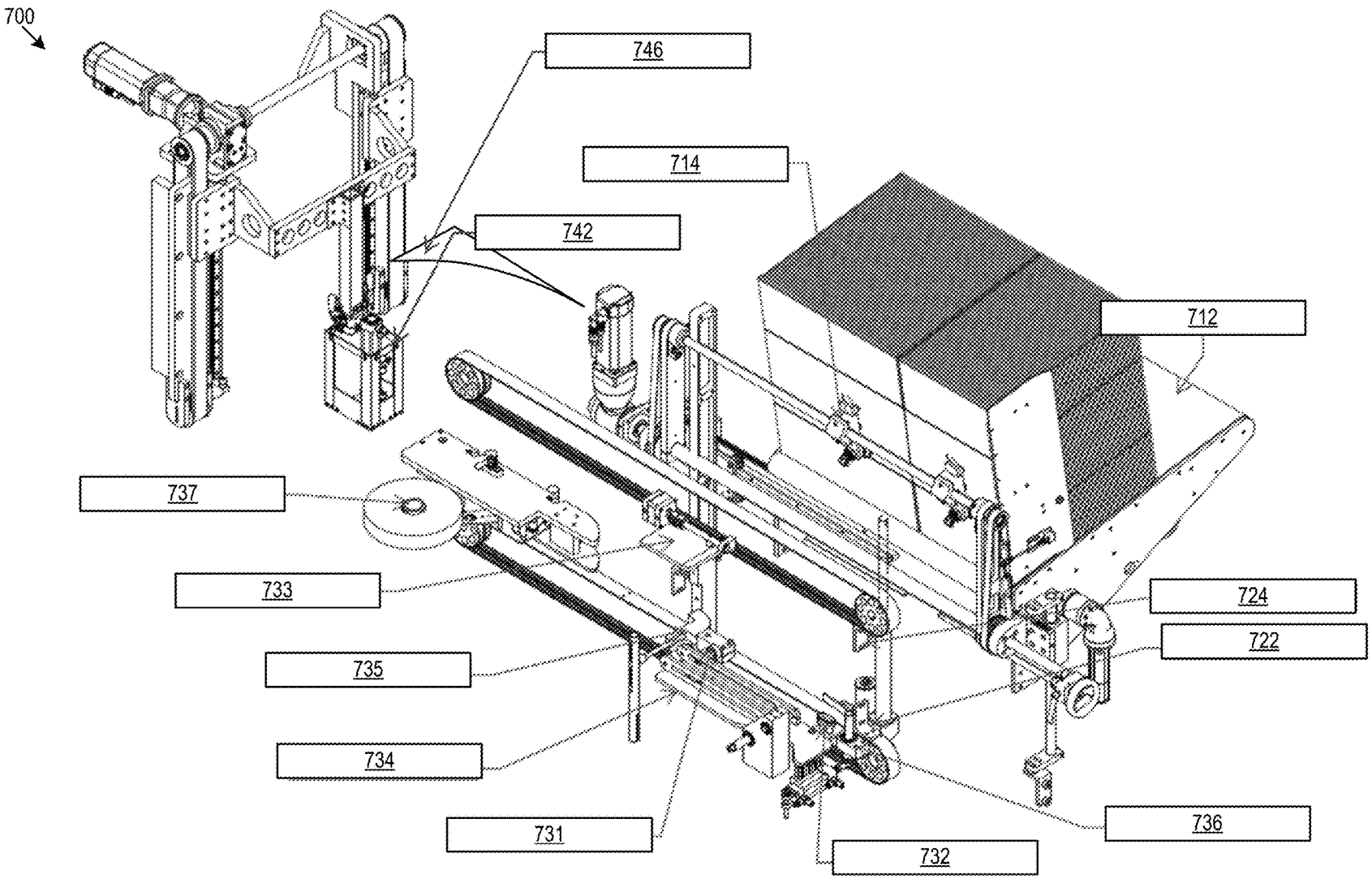
FIG. 7 shows an illustrative example case erector.

FIG. 7 shows an illustrative example case erector 700. The case erector includes a case hopper 712, a case puller 714, a bottom pusher 722, a top pusher 724, a case opener 731, a case back vacuum 732, a top major door 733, a bottom major door 734, a front minor kicker 735, a rear minor kicker 736, a tape head 737, a plunger 742, and a guide (746, e.g., for tip-output operation). The erector also may include a case formation die below the plunger 742 and glue guns (e.g., glue heads) (not shown).

Figure 8:
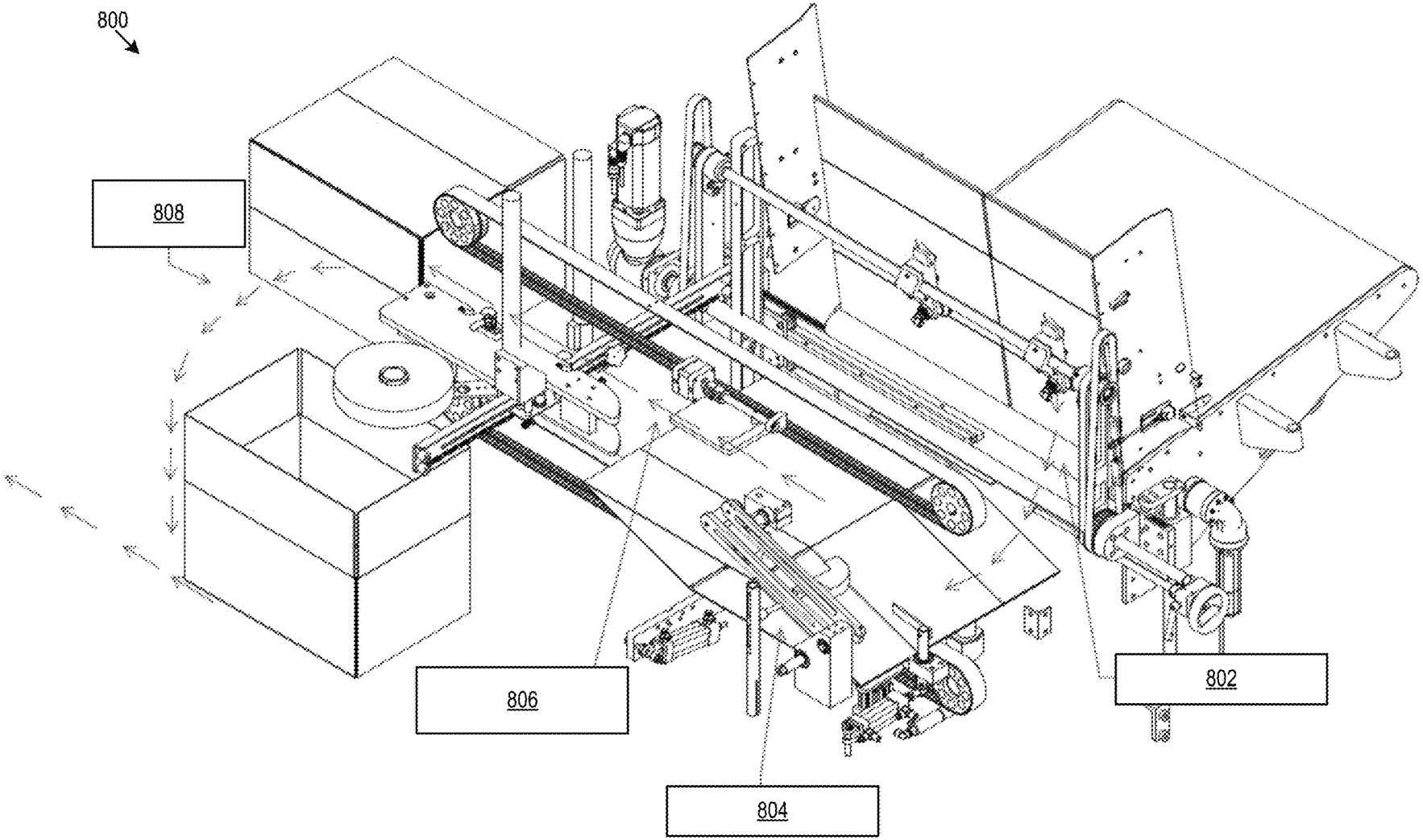
FIG. 8 shows example operation in slotted-case mode for the illustrative example case erector of FIG. 7.

FIG. 8 shows an example operation 800 in slotted-case mode for the illustrative example case erector 700. A case blank is pulled off the hopper and rotated to laying flat and set into the slotted erection area near the case opener 731 (802). The case back vacuum 732 is activated and grabs the back rear minor of the case. The case opener 731 actuates 90 degrees, grabs the length panel of the case, then actuates back up 90 degrees to open the case. The rear minor kicker 736 and front minor kicker 735 actuate 90 degrees to fold the rear minor flap and front minor flap at the same time (804). The front minor kicker 735 actuates 90 degrees out of the case. The bottom major flap 734 door actuates 90 degrees and closes the bottom flap. The case back vacuum 732 is released. The top 724 and bottom 722 case pushers move forward in sync. The top major flap door 733 closes the top flap before entering the tape head 737 (806). The top 724 and bottom 722 case pushers continue to push the case through the tape head 737. The case is pushed out of the case erector 700 and then falls on a conveyor while rotating 90 degrees due to the guide 746 (808).

Figure 9:
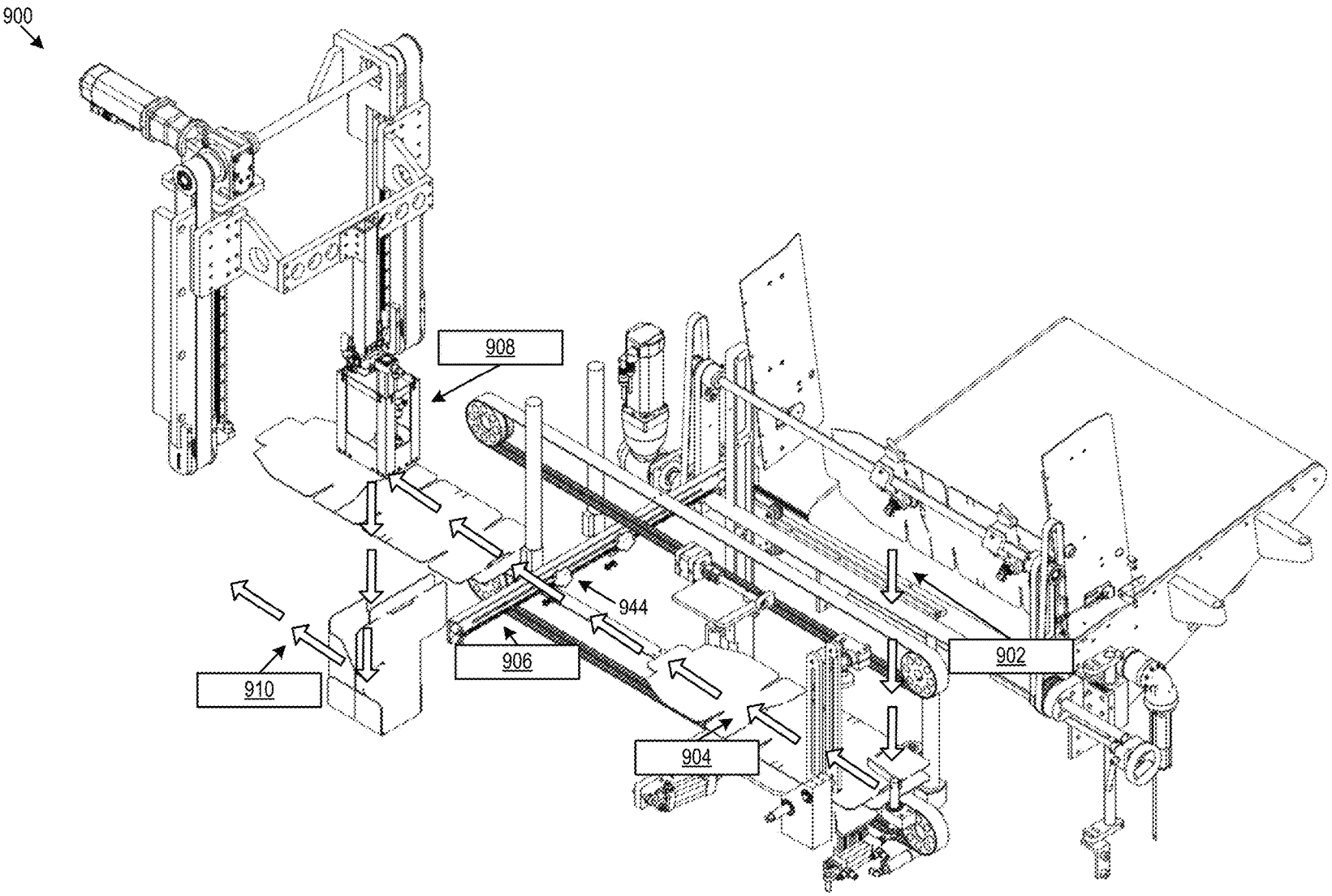
FIG. 9 shows example operation in plunger-case mode for the illustrative example case erector of FIG. 7.

FIG. 9 shows example operation 900 in plunger-case mode for the illustrative example case erector 700. A case blank is pulled off the hopper and rotated to laying flat and set into the slotted erection area near the case opener 731 (902). The bottom case pusher 722 pushes the unerected case forward trough the slotted erection area under glue guns 944 toward the plunger erection area under the plunger 742 (904). While the case is being pushed forward, glue is applied on the flaps by the glue guns 944 (906). When the blank is in position, the plunger pushed down through the case formation die and folds and compresses the case (908). The case is pushed through the die and onto the conveyor belt below (910).

For the illustrative example case erector 700 and during transition from slotted-case mode to plunger-case mode, the case opener 731, the top pusher 724, the doors and kickers 733-736, the tape head 737, case pusher side rails (e.g., for guiding cases during transport) and/or the guide may be deactivated, removed, moved to a clear position, or otherwise adjusted to accommodate non-use during the plunger case mode. The case hopper and/or case puller may also be adjusted to accommodate differences in their operation between the modes. The case plunger 742, glue guns 944, and/or case formation die may be activated, inserted, moved to a ready position, or otherwise adjusted to accommodate use during the plunger case mode.

For the illustrative example case erector 700 and during transition from plunger-case mode to slotted-case mode, the case opener 731, the top pusher 724, the doors and kickers 733-736, the tape head 737, case pusher side rails (e.g., for guiding cases during transport) and/or the guide may be activated, inserted, moved to a ready position, or otherwise adjusted to accommodate use during the slotted-case mode. The case hopper and/or case puller may be adjusted to accommodate differences in their operation between the modes. The case plunger 742, glue guns 944, and/or case formation die may be deactivated, removed, moved to a clear position, or otherwise adjusted to accommodate non-use during the slotted-case mode.

Additionally or alternatively triggering behavior may be altered between modes for certain components. The case hopper 712, case puller 714, and/or bottom case pusher 722 may have one or more triggering positions that trigger various ones of the case opener 731, case back vacuum 732, the top pusher 724, the doors and kickers 733-736, and/or the tape head 737 that are active during slotted-case mode and ignored during plunger-case mode. Additionally or alternatively, the case hopper 712, case puller 714, and/or bottom case pusher 722 may have one or more triggering positions that trigger various ones of the plunger 742 and/or glue heads 944 that are active during plunger-case mode and ignored during slotted-case mode.

Figure 10:
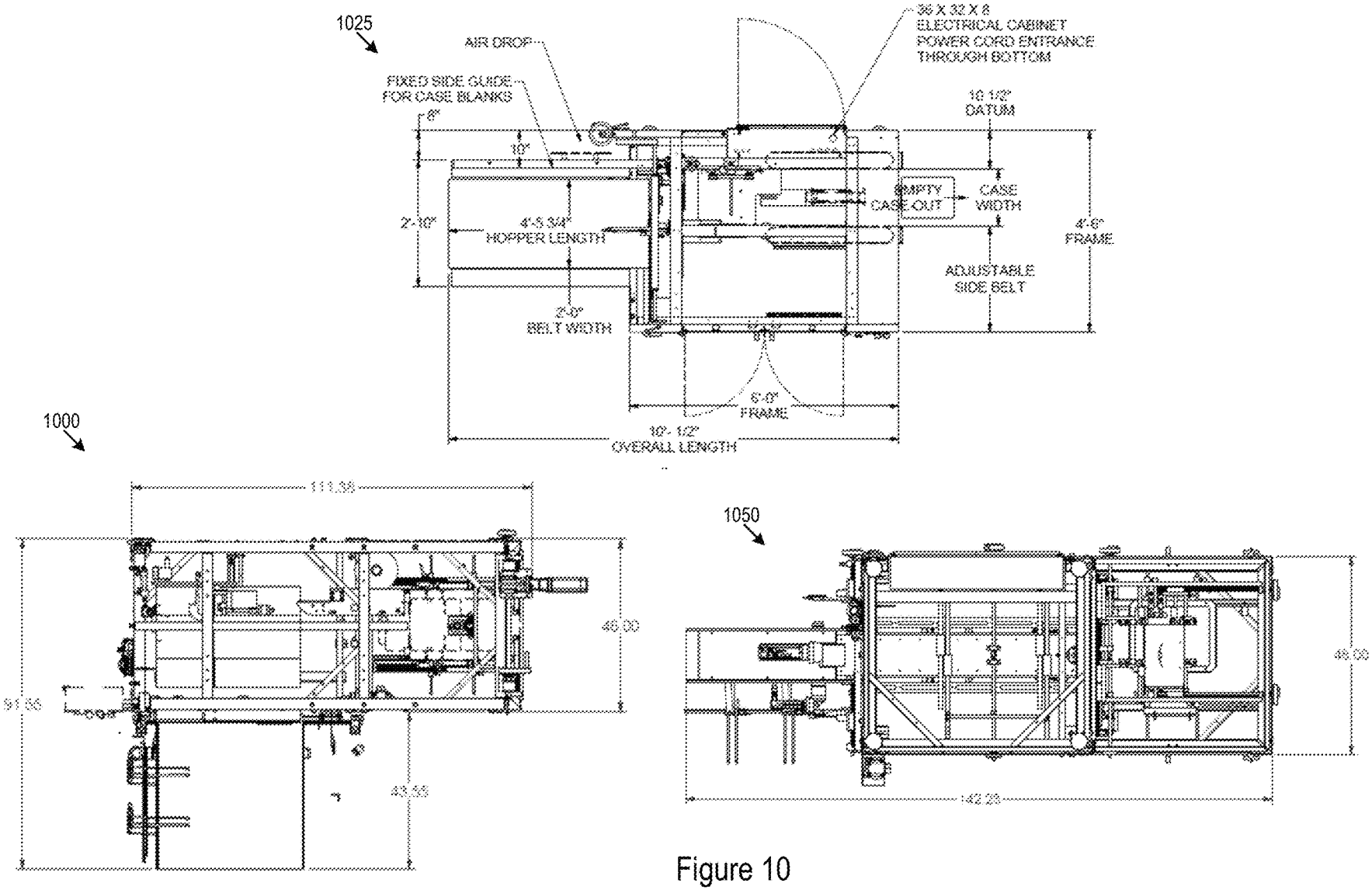
FIG. 10 shows a footprint of the illustrative example case erector of FIG. 7 alongside footprints of example single-mode case erectors.

FIG. 10 shows a footprint 1000 of the illustrative example case erector 700 alongside footprints 1025, 1050 of single mode case erectors, including a footprint 1025 of an example slotted-case erector and a footprint 1050 of an example plunger-case erector. Listed measurements are in inches and/or feet. As further evidence in the form of working examples with commercially desirable features made possible through architectures that run counter to the conventional wisdom, the footprints of the case erectors are comparable.

Table 1 shows various examples.

TABLE 1

| Examples |
|---|
| 1. A method including:<br>transitioning a case erector from a slotted-case mode to a plunger-case mode by:<br>adjusting a plunger from a point exceeding a plunger clear threshold to a plunger ready position;<br>adjusting a case opener to a point exceeding an opener clear threshold; and<br>removing a guide for tip-output operation, where:<br>optionally, the method is in accord with the method of any of the examples in this Table or includes implementing any feature of any case erector of the examples in this Table. |
| 2. The method of any of the examples in this Table, further including adjusting a hopper sizing to a plunger-case setting from a slotted-case setting. |
| 3. The method of any of the examples in this Table, further including further including deactivating a flap door, door kicker, or both. |
| 4. The method of any of the examples in this Table, further including adjusting a top case pusher to a point exceeding a pusher clear threshold, while maintaining activation of a bottom case pusher. |
| 5. The method of any of the examples in this Table, further including:<br>deactivating a slotted-case adhesive head; and<br>activating a plunger-case adhesive head. |
| 6. The method of any of the examples in this Table, where:<br>deactivating the slotted-case adhesive head includes deactivating a tape head; and<br>activating a plunger-case adhesive head includes activating a glue head. |
| 7. The method of any of the examples in this Table, where reorienting the guide for upright-output operation includes orienting the guide to clear reception of cases by a case formation die. |
| 8. The method of any of the examples in this Table, where reception of cases by a case formation die includes erecting a plunger case upon impact by the plunger by receiving the plunger case through an opening of the case formation die. |
| 9. A method including:<br>transitioning a case erector from a plunger-case mode to a slotted-case mode by:<br>adjusting a case opener from a point exceeding an opener clear threshold to an opener ready position;<br>adjusting a plunger to a point exceeding a plunger clear threshold; and<br>inserting a guide for tip-output operation, where:<br>optionally, the method is in accord with the method of any of the examples in this Table or includes implementing any feature of any case erector of the examples in this Table. |
| 10. The method of any of the examples in this Table, where adjusting a case opener from a point exceeding an opener clear threshold to an opener ready position includes manually repositioning the case opener into an engaged position. |
| 11. The method of any of the examples in this Table, where adjusting a plunger to a point exceeding a plunger clear threshold includes manually disengaging the plunger. |
| 12. The method of any of the examples in this Table, where adjusting a case opener from a point exceeding an opener clear threshold to an opener ready position includes actuating the case opener from a point outside an in-operation travel range to a point within the in-operation travel range. |
| 13. The method of any of the examples in this Table, where the case opener is configured to engage a side of a slotted-case with a case back vacuum at one end of the in-operation travel range and open the slotted case by traveling to the other end of the in-operation travel range. |
| 14. The method of any of the examples in this Table, where reorienting the guide for tip-output operation include orienting the guide to:<br>tip an erected slotted case 90 degrees to an upright position upon output from the case erector;<br>block movement of a case into a case formation die of the case erector; or both. |
| 15. A case erector including<br>a case opener;<br>a plunger; and<br>a guide;<br>where the case erector is configured for:<br>transition from a slotted-case mode to a plunger-case mode via:<br>adjustment of the plunger from a point exceeding a plunger clear threshold to a plunger ready position;<br>adjustment of the case opener to a point exceeding an opener clear threshold; and<br>removal of the guide for tip-output operation; and |

TABLE 1-continued

Examples transition from a plunger-case mode to a slotted-case mode by:
adjustment of the case opener from a point exceeding an opener clear threshold to an opener ready position;
adjustment of the plunger to a point exceeding a plunger clear threshold; and
insertion of the guide for tip-output operation, where:
optionally, the method is in accord with the method of any of the examples in this Table or includes implementing any feature of any case erector of the examples in this Table.

16. The case erector of any of the examples in this Table, further including erector circuitry configured to: actuate of the plunger to the point exceeding the plunger clear threshold;
actuate of the case opener to the point exceeding the opener clear threshold; or both 17. The case erector of any of the examples in this Table, further including:
a slotted erection area including the case opener; and
a plunger erection area including the plunger.

18. The case erector of any of the examples in this Table, where the case erector further includes a case pusher to, in the plunger-case mode, convey cases in an unfolded state through the slotted erection area to the plunger erection area.

19. The case erector any of the examples in this Table, where:
during tip-output operation:
the plunger erector area further includes the guide and is positioned at an output of the case erector; and
the guide is oriented tip erected slotted cases out of the plunger erector area through the output.

20. The case erector any of the examples in this Table, further including:
a case formation die situated below the plunger erector area to erect plunger cases when impacted by actuation of the plunger in the plunger erector area.

21. A case erector including:
a case opener;
a case pusher;
a plunger;
a case formation die including an opening structured to erect a plunger case upon impact by the plunger; and
erector circuitry configured to:
in a slotted-case mode:
deactivate the plunger;
actuate the case opener to erect a slotted case by opening the slotted case allowing a flap of the slotted case to fold unobstructed by other portions of the slotted case; and
drive the case pusher to push the slotted case past the case formation die without impact by the plunger; and
in a plunger-case mode:
deactivate the case opener;
drive the case pusher to push a plunger case past the case opener; and
drive the plunger to impact the plunger case when the plunger contain is in position to be received by the case formation die, where:
optionally, the case erector is in accord with the case erector of any of the examples in this Table or includes any feature of any case erector used in any method of the examples in this Table.

22. A method including:
for a case erector including:
a case opener;
a case pusher;
a plunger; and
a case formation die including an opening structured to erect a plunger-case upon impact by the plunger;
operating the case erector in slotted-case mode by:
deactivating the plunger;
adjusting the case opener to erect a slotted case by opening the slotted case allowing a flap of the slotted case to fold unobstructed by other portions of the slotted case; and
driving the case pusher to push the slotted case past the case formation die without impact by the plunger, where:
optionally, the method is in accord with the method of any of the examples in this Table or includes implementing any feature of any case erector of the examples in this Table.

23. A method including:
operating a case erector in a slotted-case mode by:
operating a first component of the case erector; and
deactivating, removing, and/or repositioning a second component of the case erector, where:
optionally, the first component includes:
a hopper;
a case puller;
a case pusher;
an adhesive head;

TABLE 1-continued

| Examples |
|---|
| a case back vacuum;<br>a case opener<br>a kicker;<br>a flap door;<br>a top case pusher; and/or<br>a tape head or other adhesive head; and<br>optionally, the second component includes:<br>a plunger; and/or<br>a glue head or other adhesive head, where:<br>optionally, the method is in accord with the method of any of the examples in this Table or includes implementing any feature of any case erector of the examples in this Table.<br>24. A method including:<br>for a case erector including:<br>a case opener;<br>a case pusher;<br>a plunger; and<br>a case formation die including an opening structured to erect a plunger-case upon impact by the plunger;<br>operating the case erector in plunger-case mode by:<br>deactivating the case opener;<br>driving the case pusher to push a case past the case opener; and<br>driving the plunger to impact the case when the plunger contain is in position to be received by the case formation die, where:<br>optionally, the method is in accord with the method of any of the examples in this Table or includes implementing any feature of any case erector of the examples in this Table.<br>25. A method including:<br>operating a case erector in a plunger-case mode by:<br>operating a first component of the case erector; and<br>deactivating, removing, and/or repositioning a second component of the case erector, where:<br>optionally, the first component includes:<br>a hopper;<br>a case puller;<br>a case pusher;<br>an adhesive head;<br>a plunger; and/or<br>a glue head or other adhesive head; and<br>optionally, the second component includes:<br>a case back vacuum;<br>a case opener<br>a kicker;<br>a flap door;<br>a top case pusher; and/or<br>a tape head or other adhesive head, where:<br>optionally, the method is in accord with the method of any of the examples in this Table or includes implementing any feature of any case erector of the examples in this Table.<br>26. A case erector including:<br>a case pusher including a slotted-case triggering position and a plunger-case triggering position, the slotted-case triggering position different from the plunger-case triggering position;<br>one or more adhesive heads;<br>erector circuitry configured to:<br>in a slotted-case mode:<br>responsive to a determination that the case pusher in the slotted-case triggering position, initiate actuation of at least a first head of the one or more adhesive heads for application of adhesive to a case; and<br>ignore a determination that the case pusher in the plunger-case triggering position; and<br>in a plunger-case mode:<br>responsive to a determination that of the case pusher in the plunger-case triggering position, initiate actuation of at least a second head of the one or more adhesive heads for application of adhesive to a case; and<br>ignore a determination that the case pusher in the slotted-case triggering position, where:<br>optionally, the case erector is in accord with the case erector of any of the examples in this Table or includes any feature of any case erector used in any method of the examples in this Table. |

TABLE 1-continued

| Examples |
| --- |
| 27. A method including:<br>for a case erector including:<br>a case pusher; and<br>one or more adhesive heads:<br>operating the case erector by:<br>optionally, in a slotted-case mode:<br>responsive to a determination that a case pusher in a slotted-case triggering position, initiating operation of at least a first head of one or more adhesive heads for application of adhesive to a case; and<br>ignoring a determination that the case pusher in a plunger-case triggering position, the plunger-case triggering position different from the slotted-case triggering position; and<br>optionally, in a plunger-case mode:<br>responsive to a determination that the case pusher in the plunger-case triggering position, initiating operation of at least a second head of the one or more adhesive heads for application of adhesive to a case; and<br>ignoring a determination that the case pusher in the slotted-case triggering position, where:<br>optionally, the method is in accord with the method of any of the examples in this Table or includes implementing any feature of any case erector of the examples in this Table. |
| 28. A method according to any of the examples in this Table, where the first and second adhesive head include the same adhesive head, where:<br>optionally, the adhesive head is configured to move between a slotted-case operating position and a plunger-case operating position. |
| 29. A method according to any of the examples in this Table, where the first and second adhesive heads include different adhesive heads, where:<br>optionally, the first adhesive head includes a tape head; and<br>optionally, the second adhesive head includes a glue head. |
| 30. A method including:<br>for a case erector including:<br>a triggering component;<br>a first triggered component; and<br>a second triggered component:<br>operating the case erector by:<br>optionally, in a slotted-case mode:<br>responsive to a determination that the triggering component in a slotted-case triggering position, initiating operation the first triggered component; and<br>ignoring a determination that of the triggering component in a plunger-case triggering position, the plunger-case triggering position different from the slotted-case triggering position; and<br>optionally, in a plunger-case mode:<br>responsive to a determination that the triggering component in the plunger-case triggering position, initiating operation of the first triggered component; and<br>ignoring a determination that the triggering component in the slotted-case triggering position, where:<br>optionally, the method is in accord with the method of any of the examples in this Table or includes implementing any feature of any case erector of the examples in this Table. |
| 31. A case erector including:<br>a triggering component;<br>a first triggered component;<br>a second triggered component; and<br>erector circuitry configured to:<br>in a slotted-case mode:<br>responsive to a determination that the triggering component in a slotted-case triggering position, initiate operation the first triggered component; and<br>ignore detection of the triggering component in a plunger-case triggering position, the plunger-case triggering position different from the slotted-case triggering position; and<br>in a plunger-case mode:<br>responsive to detection of the triggering component in the plunger-case triggering position, initiate operation of the first triggered component; and<br>ignore detection of the triggering component in the slotted-case triggering position, where:<br>optionally, the case erector is in accord with the case erector of any of the examples in this Table or includes any feature of any case erector used in any method of the examples in this Table. |

Various implementations have been specifically described. However, many other implementations are also possible.

What is claimed is:

1. A method of transitioning a case erector from a slotted-case mode to a plunger-case mode, the method comprising:

adjusting a plunger from a point exceeding a plunger clear threshold to a plunger ready position;

adjusting a case opener to a point exceeding an opener clear threshold;

adjusting a guide used for tip-output operation; and where adjusting the guide for tip-output operation includes removing the guide to clear reception of cases by a case formation die.

2. The method of claim 1, further including adjusting a hopper sizing to a plunger-case setting from a slotted-case setting.

3. The method of claim 1, further including deactivating a flap door.

4. The method of claim 1, further including adjusting a top case pusher to a point exceeding a pusher clear threshold, while maintaining activation of a bottom case pusher.

5. The method of claim 1, further including:

deactivating a slotted-case adhesive head; and activating a plunger-case adhesive head.

6. The method of claim 5, where:

deactivating the slotted-case adhesive head includes deactivating and repositioning a tape head; and activating a plunger-case adhesive head includes activating a glue head.

7. The method of claim 1, where reception of cases by a case formation die includes erecting a plunger case upon impact by the plunger by receiving the plunger case through an opening of the case formation die.

8. The method of claim 1, where adjusting the plunger from a point exceeding a plunger clear threshold to a plunger ready position includes manually repositioning the plunger into an engaged position.

9. The method of claim 8, where adjusting the plunger from the point exceeding a plunger clear threshold to a plunger ready position includes actuating the plunger from a point outside an in-operation travel range to a point within the in-operation travel range.

10. The method of claim 1, where adjusting the case opener to the point exceeding an opener clear threshold includes manually repositioning an arm of the case opener.

11. The method of claim 1, where the case opener is configured to engage a side of a slotted-case with a case back vacuum at one end of an in-operation travel range and open the slotted case by traveling to an other end of the in-operation travel range.

12. The method of claim 1, further including deactivating a door kicker.

13. A method of transitioning a case erector from a plunger-case mode to a slotted-case mode, the method comprising:

adjusting a case opener from a point exceeding an opener clear threshold to an opener ready position;

adjusting a plunger to a point exceeding a plunger clear threshold; and inserting a guide for tip-output operation; and orienting the guide to block movement of a case into a case formation die of the case erector.

14. The method of claim 13, where adjusting the case opener from a point exceeding the opener clear threshold to the opener ready position includes manually repositioning the case opener into an engaged position.

15. The method of claim 13, where adjusting the plunger to the point exceeding the plunger clear threshold includes manually disengaging the plunger.

16. The method of claim 13, where adjusting the case opener from the point exceeding the opener clear threshold to the opener ready position includes actuating the case opener from a point outside an in-operation travel range to a point within the in-operation travel range.

17. The method of claim 13, where the case opener is configured to engage a side of a slotted-case with a case back vacuum at one end of the in-operation travel range and open the slotted case by traveling to the other end of the in-operation travel range.

18. The method of claim 13, further comprising orienting the guide to tip an erected slotted case 90 degrees to an upright position upon output from the case erector.

19. A method of transitioning a case erector from a plunger-case mode to a slotted-case mode, the case erector including a case opener, a case pusher, a plunger, and a case formation die having an opening structured to erect a plunger-case upon impact by the plunger, the method including:

deactivating the plunger;

adjusting the case opener to erect a slotted case by opening the slotted case allowing a flap of the slotted case to fold unobstructed by other portions of the slotted case; and driving the case pusher to push the slotted case past the case formation die without impact by the plunger.

20. The method of claim 19, further comprising tipping an erected slotted case 90 degrees to an upright position during output from the case erector.

* * * * *